US008692759B2

(12) United States Patent
Park et al.

(10) Patent No.: US 8,692,759 B2
(45) Date of Patent: Apr. 8, 2014

(54) METHOD FOR DRIVING A LIGHT SOURCE AND LIGHT SOURCE APPARATUS FOR PERFORMING THE METHOD

(75) Inventors: Se-Ki Park, Suwon-si (KR); Dong-Min Yeo, Asan-si (KR); Gi-Cherl Kim, Yongin-si (KR); Si-Joon Song, Suwon-si (KR); Chi-O Cho, Asan-si (KR); Young-Keun Lee, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 1152 days.

(21) Appl. No.: 12/482,959

(22) Filed: Jun. 11, 2009

(65) Prior Publication Data

US 2010/0171690 A1 Jul. 8, 2010

(30) Foreign Application Priority Data

Jan. 6, 2009 (KR) ..... 10-2009-0000820

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 6,513,949 | B1 * | 2/2003 | Marshall et al. | 362/231 |
| 2002/0070681 | A1 * | 6/2002 | Shimizu et al. | 315/246 |
| 2003/0231161 | A1 * | 12/2003 | Yamaguchi | 345/102 |
| 2004/0114396 | A1 * | 6/2004 | Kobayashi et al. | 362/561 |
| 2004/0217364 | A1 * | 11/2004 | Tarsa et al. | 257/89 |
| 2005/0140640 | A1 * | 6/2005 | Oh et al. | 345/102 |
| 2006/0138435 | A1 * | 6/2006 | Tarsa et al. | 257/89 |
| 2006/0146005 | A1 * | 7/2006 | Baba et al. | 345/102 |
| 2006/0208999 | A1 * | 9/2006 | Lee et al. | 345/102 |
| 2007/0152926 | A1 * | 7/2007 | Kwon | 345/82 |
| 2007/0247833 | A1 * | 10/2007 | Lee et al. | 362/97 |
| 2007/0284994 | A1 * | 12/2007 | Morimoto et al. | 313/483 |
| 2008/0111784 | A1 * | 5/2008 | Tanaka et al. | 345/102 |
| 2008/0203929 | A1 * | 8/2008 | Park et al. | 315/158 |
| 2008/0278432 | A1 * | 11/2008 | Ohshima | 345/102 |

(Continued)

FOREIGN PATENT DOCUMENTS

| | | | |
|---|---|---|---|
| JP | 2003515956 | A | 5/2003 |
| JP | 2006039520 | A | 2/2006 |

(Continued)

*Primary Examiner* — Claire X Wang
*Assistant Examiner* — Robert Stone
(74) *Attorney, Agent, or Firm* — Cantor Colburn LLP

(57) ABSTRACT

A light source apparatus includes light-emitting blocks, a local dimming control part and a light source driving part driving. The light-emitting blocks include a first-color light source which emits first-color light and a second-color light source which emits second-color light. The second-color light source includes a third-color chip and a fourth-color phosphor disposed on the third-color chip, and is disposed as one package to emit the second-color light therefrom. The local dimming control part compensates a driving current of the first-color light source and a driving current of the second-color light source of each of the light-emitting blocks. The light source driving part drives the first-color light source and the second-color light sources based on the driving current of the first-color light source and the a driving current of the second-color light source, respectively, each compensated by the local dimming control part.

19 Claims, 5 Drawing Sheets
(1 of 5 Drawing Sheet(s) Filed in Color)

(56) References Cited

U.S. PATENT DOCUMENTS

| | | | | |
|---|---|---|---|---|
| 2009/0058792 | A1* | 3/2009 | Park et al. | 345/102 |
| 2009/0109165 | A1* | 4/2009 | Park et al. | 345/102 |
| 2009/0109166 | A1* | 4/2009 | Lee et al. | 345/102 |
| 2009/0189543 | A1* | 7/2009 | Yeo et al. | 315/297 |
| 2009/0225021 | A1* | 9/2009 | Ye et al. | 345/102 |
| 2009/0267926 | A1* | 10/2009 | Seo et al. | 345/204 |
| 2010/0066943 | A1* | 3/2010 | Akiba et al. | 349/62 |

FOREIGN PATENT DOCUMENTS

| | | | |
|---|---|---|---|
| JP | 2007286627 | A | 11/2007 |
| JP | 2007318050 | A | 12/2007 |
| JP | 2008147187 | A | 6/2008 |

* cited by examiner

METHOD FOR DRIVING A LIGHT SOURCE AND LIGHT SOURCE APPARATUS FOR PERFORMING THE METHOD

This application claims priority to Korean Patent Application No. 2009-820, filed on Jan. 6, 2009, and all the benefits accruing therefrom under 35 U.S.C. §119, the contents of which in its entirety are herein incorporated by reference.

BACKGROUND OF THE INVENTION

1. Field of the Invention

Exemplary embodiments of the present invention provide a method for driving a light source and a light source apparatus for performing the method. More particularly, exemplary embodiments of the present invention provide a two-way dimming method for driving a light source and a light source apparatus for performing the method used in a liquid crystal display ("LCD") apparatus.

2. Description of the Related Art

Generally, a liquid crystal display ("LCD") apparatus displays an image by controlling electrical and optical characteristics of liquid crystal. LCD apparatuses have various advantages over other types of display apparatuses, such as smaller thickness, lighter weight, lower power consumption and lower driving voltage, for example. Accordingly, the LCD apparatuses are widely used in monitors, laptop computers, cellular phones and televisions, for example. The LCD apparatus typically includes an LCD panel which displays the image by controlling a light transmittance of the liquid crystal and a backlight assembly disposed under the LCD panel to provide light to the LCD panel.

The LCD panel typically includes an array substrate having thin-film transistors ("TFTs") disposed in a substantially matrix pattern thereon, a color filter substrate disposed opposite to, e.g., facing, the array substrate and a liquid crystal layer interposed between the array substrate and the color filter substrate.

The backlight assembly includes a light source which generates the light for displaying the image on the LCD panel. The light source may be, for example, a cold cathode fluorescent lamp ("CCFL"), a hot cathode fluorescent lamp ("HCFL") or a light-emitting diode ("LED"). In addition, a plurality of LEDs has also been used as the light source, since LEDs have low power consumption and high color reproducibility, as compared to other types of light sources.

The LCD apparatus typically further includes a driving part and a controlling part for driving the backlight assembly. More specifically, the controlling part controls the driving part using a pulse width modulation ("PWM") control method, for example, for controlling a light intensity of LEDs of the plurality of LEDs based on characteristics of high-speed driving the LEDs. The PWM control method provides the LEDs with a static current by generating pulses, comparing pulse widths and modulating pulse widths, for example.

The plurality of LEDs typically includes a red LED, a green LED and a blue LED ("RGB LEDs"). Red light, green light and blue light, emitted from the red LED, the green LED and the blue LED, respectively, are mixed to emit white light and/or light of different colors.

When the RGB LEDs are disposed in packages, however, manufacturing costs are higher than manufacturing costs for a backlight assembly including white LEDs. In addition, when the RGB LEDs are disposed in a single package, a required number of wires connected to the single package is substantially increased.

Therefore, a two-way dimming method using two LEDs to generate both a standard RGB ("sRGB") color space and an ADOBE® RGB color space is required.

BRIEF SUMMARY OF THE INVENTION

Exemplary embodiments provide a method for driving a light source having substantially decreased manufacturing costs and improved power efficiency thereof.

Exemplary embodiments also provide a light source apparatus for performing the method.

According to an exemplary embodiment, in a method for driving a light source, the light source including light-emitting blocks, each including a first-color light source which emits first-color light and a second-color light source which emits second-color light, the second-color light source including a third-color chip and a fourth-color phosphor disposed on the third-color chip and being formed as one package to emit the second-color light therefrom, the method includes: compensating a driving current of the first-color light source and a driving current of the second-color light source of each of the light-emitting blocks to generate a compensated driving current of the first-color light source and a compensated driving current of the second-color light source; and driving the first-color light source and the second-color light source based on the compensated driving current of the first-color light source and the compensated driving current of the second-color light source, respectively.

The compensating the driving current of the first-color light source and the driving current of the second-color light source includes: determining a duty of the driving current of the first-color light source and a duty of the driving current of the second-color light source using image data corresponding to the light-emitting blocks; determining a driving mode of each of the light-emitting blocks based on the duty of the driving current of the first-color light source and the duty of the driving current of the second-color light source; and compensating the driving current of the first-color light source and the driving current of the second-color light source based on the driving mode.

The determining the duty of the driving current of the second-color light source includes: generating representative data by sampling a larger one of third-color and fourth-color data of the image data; and determining the duty of the driving current of the second-color light source based on the representative data.

The compensating the driving current of the first-color light source and the second-color light source may include time-filtering the duty of the driving current of the first-color light source and the duty of the driving current of the second-color light source when a corresponding light-emitting block operates in a normal mode.

The compensating the driving current of the first-color light source and the driving current of the second-color light source may include compensating at least one of the duty and a level of at least one of the driving current of the first-color light source and the driving current of the second-color light source when a corresponding light-emitting block operates in a boost mode.

The compensating the at least one of the duty and the level of the at least one of the driving current of the first-color light source and the driving current of the second-color light source may include compensating the duty of the driving current of the first-color light source when the level of the driving current of the first-color light sources is maximum and compensating the level of the driving current of the second-color light source when the duty of the driving current of the second-color light source is maximum, such that the compensating the duty of the driving current of the first-color light source and the compensating the level of the driving current of the second-color light source correspond to target color coordinates and target luminance.

The compensating the at least one of the duty and the level of the at least one of the driving current of the first-color light source and the driving current of the second-color light source may include using a lookup table which stores a pair comprising the duty of the driving current of the first-color light source and the level of the driving current of the second-color light source corresponding to target color coordinates and target luminance.

The compensating the at least one of the duty and the level of the at least one of the driving current of the first-color light source and the driving current of the second-color light source may further include additionally compensating the duty of the driving current of the second-color light source when the level of the driving current of the second-color light sources is greater than a predetermined value.

The first-color light source may include a green light-emitting diode ("LED"), and the second-color light source may include a magenta LED which includes a blue chip and a red phosphor disposed on the blue chip.

The first-color light source may include a red LED, and the second-color light source may include a cyan LED which includes a blue chip and a green phosphor disposed on the blue chip.

According to an alternative exemplary embodiment, a light source apparatus includes light-emitting blocks, a local dimming control part and a light source driving part driving. Each of the light-emitting blocks includes a first-color light source which emits first-color light and a second-color light source which emits second-color light. The second-color light source includes a third-color chip and a fourth-color phosphor disposed on the third-color chip, the third-color chip and the fourth-color phosphor disposed as one package to emit the second-color light therefrom. The local dimming control part compensates a driving current of the first-color light source and a driving current of the second-color light source of each of the light-emitting blocks. The light source driving part drives the first-color light source and second-color light source based on the driving current of the first color light source and the driving current of the second-color light source, each compensated by the local dimming control part.

The local dimming control part may include a duty determining part, a driving mode determining part and a compensating part. The duty determining part may determine a duty of the driving current of the first-color light source and a duty of the driving current of the second-color light source using image data corresponding to the light-emitting blocks. The driving mode determining part may determine a driving mode of each of the light-emitting blocks based on the duty of the driving current of the first-color light source and the duty of the driving current of the second-color light source. The compensating part may compensate the driving current of the first-color light source and the driving current of the second-color light source based on the driving mode.

The compensating part may time-filter the duty of the driving current of the first-color light source and the duty of the driving current of the second-color light source when a corresponding light-emitting block operates in a normal mode, and may compensate at least one of the duty and a level of at least one of the driving current of the first-color light source and the driving current of the second-color light source when the corresponding light-emitting block operates in a boost mode.

The compensating part may compensate the duty of the driving current of the first-color light source when the level of the driving current of the first-color light source is maximum and may compensate the level of the driving current of the second-color light source when the duty of the driving current of the second-color light sources is maximum, such that the duty of the driving current of the first-color light source and the level of the driving current of the second-color light source correspond to target color coordinates and target luminance when the corresponding light-emitting block operates in the boost mode.

The compensating part may use a lookup table which stores a pair including the duty of the driving current of the first-color light sources and the level of the driving current of the second-color light source corresponding to the target color coordinates and the target luminance.

The first-color light source may include a red LED, and the second-color light source may include a cyan LED which includes a blue chip and a green phosphor disposed on the blue chip.

The first-color light source may include a green LED, and the second-color light source may include a magenta LED which includes a blue chip and a red phosphor disposed on the blue chip.

The first-color light source and the second-color light source may include at least one red chip, at least one blue chip and a green phosphor disposed on the at least one red chip and the at least one blue chip, and the first-color light source and the second-color light source may be integrally disposed with each other as an LED.

The third-color chip may include a plurality of color chips.

The fourth-color phosphor may be mixed with a silicone resin or an epoxy resin.

Thus, according to exemplary embodiments, a light source apparatus uses LEDs of two colors, and a manufacturing cost and power consumption thereof is substantially decreased by reducing a required number of LEDs and driving circuits, while a reliability of the light source apparatus is substantially increased by reducing a required number of wires.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
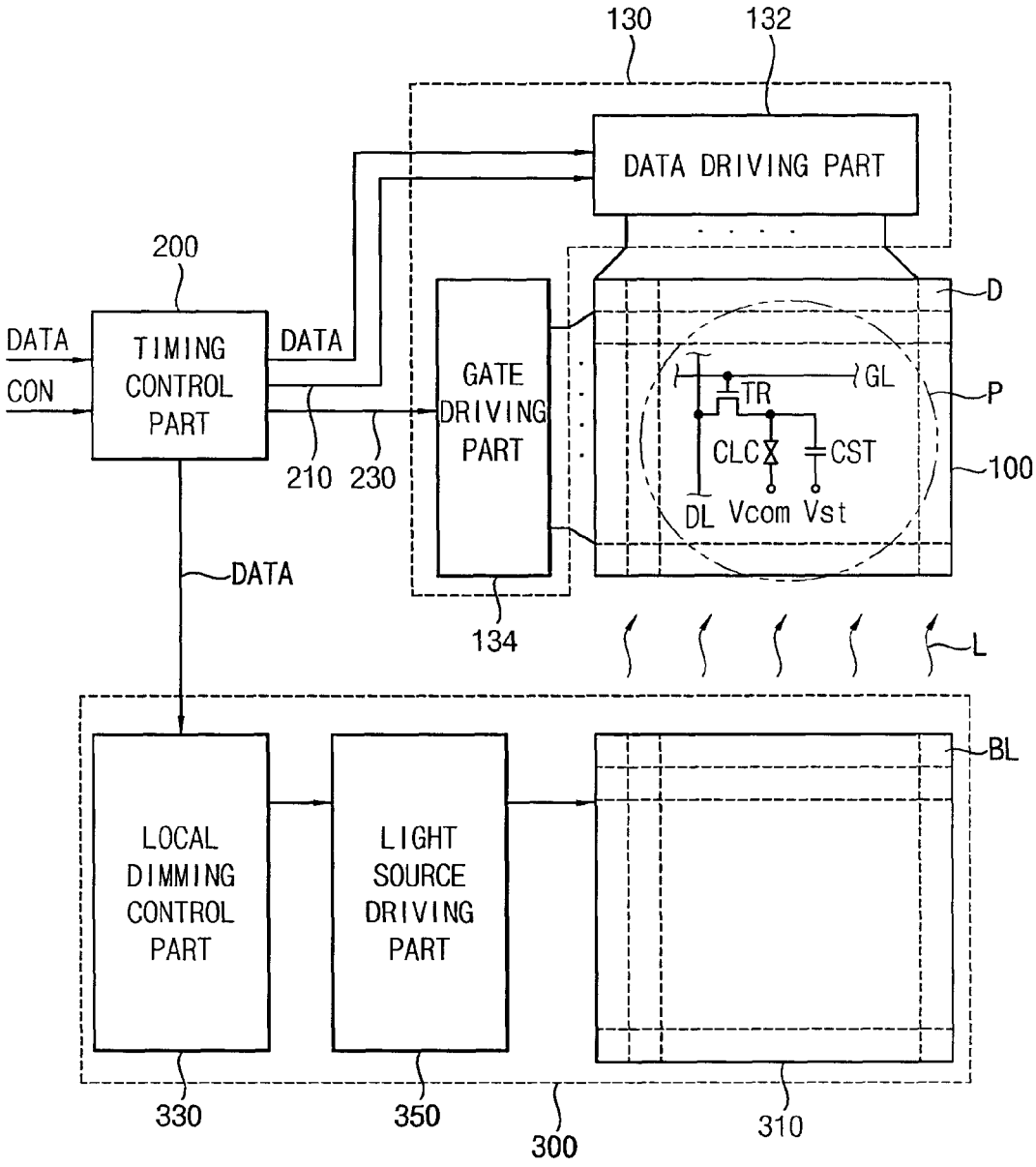
FIG. 1 is a block diagram of an exemplary embodiment of a display device according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments will be described in further detail with reference to the accompanying drawings.

Figure 2:
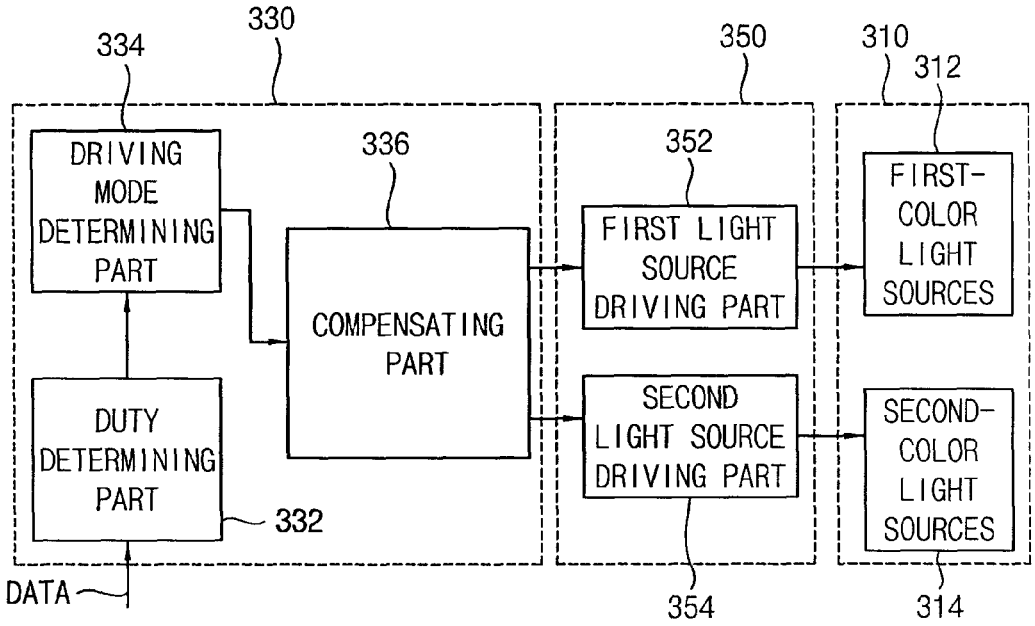
FIG. 2 is a block diagram of an exemplary embodiment of a light source apparatus of the display device shown in FIG. 1.

FIG. 1 is a block diagram of an exemplary embodiment of a display device according to the present invention. FIG. 2 is a block diagram of an exemplary embodiment of a light source apparatus of the display device shown in FIG. 1.

Referring to FIG. 1, a display device according to an exemplary embodiment includes a display panel 100, a panel driving part 130, a timing control part 200 and a light source apparatus 300.

The display panel 100 includes pixels P which display an image. In an exemplary embodiment, for example, a number of the pixels P may be M×N (where "M" and "N" are natural numbers). Each of the pixels P includes a switching element TR connected to a gate line GL and a data line DL, a liquid crystal capacitor CLC connected to the switching element TR and a common voltage Vcom, and a storage capacitor CST connected to the switching element TR and which stores a storage voltage Vst.

The timing control part 200 receives a control signal CON and an image signal DATA from an external device (not shown). The control signal CON may include a vertical start signal, a horizontal start signal and a clock signal, for example. The timing control part 200 generates a first control signal 210 and a second control signal 230 to control the panel driving part 130 based on the control signal CON.

The panel driving part 130 drives the display panel 100 by using the first control signal 210 and the second control signal 230 from the timing control part 200.

The panel driving part 130 may include a data driving part 132 and a gate driving part 134. The first control signal 210 controls a driving timing of the data driving part 132. The first control signal 210 may include the clock signal and the horizontal start signal of the control signal CON. The second control signal 230 controls a driving timing of the gate driving part 134. The second control signal 230 may include the vertical start signal of the control signal CON.

The data driving part 132 generates data signals based on the first control signal 210 and the image signal DATA, and provides the data signals to the data line DL.

The gate driving part 134 generates gate signals for activating the gate line GL based on the second control signal 230, and provides the gate signals to the gate line GL.

Referring to FIGS. 1 and 2, the light source apparatus 300 includes a light source module 310, a local dimming control part 330 and a light source driving part 350.

In an exemplary embodiment, the light source module 310 is divided into I×J (where "I" and "J" are natural numbers) light-emitting blocks BL. Each of the light-emitting blocks BL emit light L having luminance corresponding to a grayscale of an image displayed on the display panel 100 corresponding to each of the light-emitting blocks BL.

Each of the light-emitting blocks BL includes first-color light sources 312 which emit first-color light and second-color light sources 314 which emit second-color light. The first-color light sources 312 and the second-color light sources 314 may be mounted on a printed circuit board ("PCB").

The light source module 310 is driven by a local dimming method. The first-color light sources 312 and the second-color light sources 314 may be light-emitting diodes ("LEDs"). The light source module 310 will be described later in further detail below.

The light source driving part 350 generates driving currents for driving the first-color light sources 312 and the second-color light sources 314 of each of the light-emitting blocks BL. The light source driving part 350 may include a first light source driving part 352 driving the first-color light sources 312 and a second light source driving part 354 driving the second-color light sources 314.

The local dimming control part 330 compensates the driving currents of the first-color light sources 312 and the second-color light sources 314. The light source driving part 350 applies the driving currents to each of the light-emitting blocks BL, using the image signal DATA.

The local dimming control part 330 includes a duty determining part 332, a driving mode determining part 334 and a compensating part 336.

The duty determining part 332 determines duties of the driving currents of the first-color light sources 312 and the second-color light sources 314, based on the image signal DATA, corresponding to each of the light-emitting blocks BL.

The duty determining part 332 divides the image signal DATA provided from the timing control part 200 image blocks D (FIG. 1) corresponding to each of the light-emitting blocks BL. The duty determining part 332 determines the duties of the driving currents of the first-color light sources 312 and the second-color light sources 314 by using red, green and blue color data of each of the image blocks D. The duties of the driving currents are determined based on representative data of the first-color light sources 312 and the second-color light sources 314. In an exemplary embodiment, the representative data is a maximum grayscale data or, alternatively, an average data of the red, green and blue color data of the image block D.

The driving mode determining part 334 determines a driving mode of each light-emitting block BL by using the duty of the driving currents corresponding to each image block D. For example, when a deviation between the duties of the driving currents of the light-emitting blocks BL is relatively uniform, the driving mode determining part 334 may determine the driving mode to be normal mode. When a maximum duty of the driving current is condensed at some light-emitting block BL, however, the driving mode determining part 334 may determine the driving mode to be a boost mode.

When the light-emitting block BL operates in the normal mode, the compensating part 336 time-filters the duties of the driving currents of the first-color light sources 312 and the second-color light sources 314, and provides the time-filtered duties of the driving currents to the light source driving part 350.

The compensating part 336 compensates at least one of the duties and levels of the driving currents of at least one of the first-color light sources 312 and the second-color light sources 314, when the light-emitting block BL operates in the boost mode. In this case, the compensating part 336 compensates the duty of the driving current of the first-color light sources 312 when the level of the driving current of the first-color light sources 312 is maximum, and compensates the level of the driving current of the second-color light sources 314 when the duty of the driving current of the second-color light sources 314 is maximum, to substantially correspond to target color coordinates and target luminance values at the same time.

The compensating part 336 according to an exemplary embodiment may use a lookup table to compensate the duty of the driving current of the first-color light sources 312 and the level of the driving current of the second-color light sources 314. The lookup table stores the duty of the driving current of the first-color light sources 312 and the level of the driving current of the second-color light sources 314 corresponding to the target color coordinates and the target luminance as a pair. The compensating part 336 will be described in further detail below.

Figure 3A:
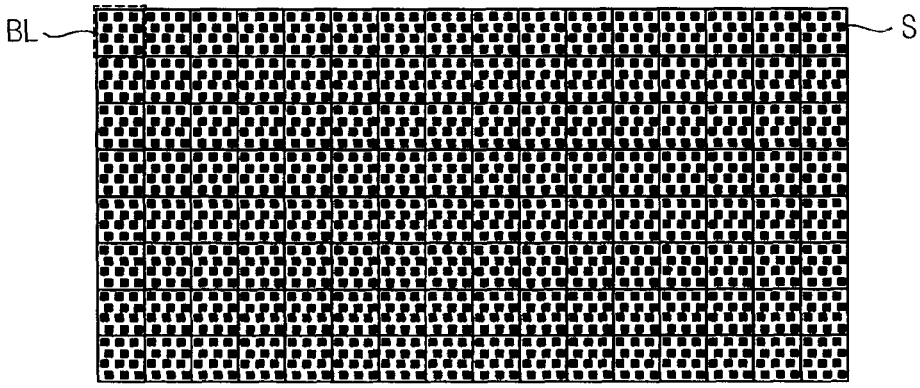
FIG. 3A is a block diagram of an exemplary embodiment of a light source module of the display device shown in FIG. 1.
Figure 3B:
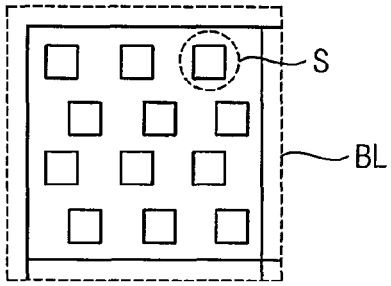
FIG. 3B is an enlarged block diagram of a light-emitting block of the light source module shown in FIG. 3A.

FIG. 3A is a block diagram of an exemplary embodiment of a light source module of the display device shown in FIG. 1. FIG. 3B is an enlarged block diagram of a light-emitting block of the light source module shown in FIG. 3A. FIGS. 4-7 are plan views of exemplary embodiments of a light-emitting group of the light-emitting block shown in FIG. 3B.

Referring to FIG. 3, in a display panel 100 according to an exemplary embodiment measuring 46 inches, for example, the light source module 310 includes 8×16 light-emitting blocks BL. Each light-emitting block BL includes 12 light-emitting groups S.

In a display panel according to the prior art, each light-emitting group typically includes red, green and blue LEDs, each disposed in a package. In an exemplary embodiment, however, LEDs of two colors are implemented to substantially reduce a required number of LEDs. Exemplary embodiments also substantially reduce manufacturing costs and substantially increase reliability, since the required number of LEDs and a required number of wires are decreased.

The light-emitting group S according to an exemplary embodiment includes the first-color light source 312 and the second-color light source 314. For example, the first-color light source 312 may be one of a red, green or blue LED. The second-color light source 314 may be disposed in a package including a chip and a phosphor. The chip has one color, which is not the same as the color included in the first-color light source 312. The phosphor has another color and is disposed on the chip. In an exemplary embodiment, the phosphor covers the chip.

Figure 4:
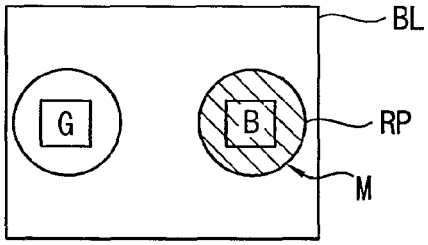
FIGS. 4-7 are plan views of exemplary embodiments of a light-emitting group of the light-emitting block shown in FIG. 3B.

Referring to FIG. 4, for example, each light-emitting group S includes a green LED G and a magenta LED M. The magenta LED M includes a blue chip B and a red phosphor RP disposed on, e.g., substantially covering the blue chip B. The red phosphor RP may be mixed with a silicone resin or an epoxy resin. The green LED G and the magenta LED M may be disposed of in packages. Alternatively the green LED G and the magenta LED M may be formed in a single package.

The light source apparatus 300 according to an exemplary embodiment includes the magenta LED M instead of blue and red LEDs, and a reference wavelength of color coordinates is therefore adjusted to cover both the standard red green blue ("sRGB") and ADOBE® RGB color spaces. For example, a reference wavelength of blue light may be adjusted from about 450 nm to about 460 nm, while a reference wavelength of green light may be adjusted from about 525 nm to about 535 nm.

For two-way dimming according to an exemplary embodiment, the adjustment of the color coordinates covers both the sRGB and the ADOBE® RGB color spaces. For example, the green LED G includes indium (In) of indium gallium nitride ("InGaN") as a base material. Thus, in the green LED G, carriers are concentrated on portions at a lower energy level, and a concentration of carriers is accelerated at increased current.

Since luminance is required to be increased to about 500 nit (from about 300 nit) to be a full white mode, color coordinates of the green LED G may be distorted when the driving mode is the boost mode. Thus, the pair of the duty of the driving current of the green LED G and the level of the driving current of the magenta LED M may be adjusted, so that distortion of the color coordinates is effectively prevented.

Hereinafter, a method for compensating for distortion, e.g., for effectively preventing distortion, of the color coordinates will be described in further detail with reference to FIG. 4.

Referring to FIGS. 1, 2 and 4, when the duty determining part 332 determines the duties of the driving currents of the first-color light sources 312 and the second-color light sources 314 in accordance with the image signal DATA corresponding to each of the light-emitting blocks BL, the duty determining part 332 uses the representative data of the first-color light sources 312 and the second-color light sources 314. The green data of the image signal DATA may be determined as the representative data of the green LED G. One of the red data and the blue data of the image signal DATA which is larger than the other may be determined as the representative data of the magenta LED M.

The driving mode determining part 334 determines the driving mode of each light-emitting block BL by using the duty of the driving current corresponding to each image block D. When the deviation between the duties of the driving currents of the light-emitting blocks BL is uniform, the driving mode determining part 334 may determine the driving mode in the normal mode. When the maximum duty of the driving current is condensed at some light-emitting blocks BL, the driving mode determining part 334 may determine the driving mode in the boost mode.

The compensating part 336 time-filters the duties of the driving currents and provides the time-filtered duties of the driving currents to the green LED G and the magenta LED M when the light-emitting block BL operates in the normal mode.

The compensating part 336 compensates the pair including the duty of the driving current of the green LED G and the level of the driving current of the magenta LED M, when the light-emitting block BL operates in the boost mode. The compensating part 336 may use the lookup table that stores the duty of the driving current of the green LED G and the level of the driving current of the magenta LED M corresponding to the target color coordinates and the target luminance as the pair.

For example, in the display panel 100 according to an exemplary embodiment which measures 46 inches, the display device is designed to adjust the duty and the level of the driving currents so that power consumption does exceed about 100 W, for example.

The power consumption may be calculated by Equation 1.

$$P_{normal} = i_G \times \sum_{j=1}^{N} D_G, \text{full} + i_M \times \sum_{k=1}^{N} D_M, \text{full} \qquad \text{Equation 1}$$

In Equation 1, P is power consumption, $i_G$ is the level of the driving current of the green LED G and $D_G$ is the duty of the driving current of the green LED G $i_M$ is the level of the driving current of the magenta LED M and $D_M$ is the duty of the driving current of the magenta LED M.

In Equation 1, when the level $i_G$ of the driving current of the green LED G and the duty $D_M$ of the driving current of the magenta LED M have maximum values and the power consumption P is about 100 W, the characteristic equation is Equation 2.

$$i_G \times \sum_{j=1}^{N} (D_G)'_j + i'_M \times \sum_{k=1}^{N} (D_M)_k = P_{normal} \qquad \text{Equation 2}$$

The lookup table stores the duty $D_G$ of the driving current of the green LED G and the level $i_M$ of the driving current of the magenta LED M as the pair which satisfies Equation 2 to maintain the target color coordinates and the target luminance. For example, the duty $D_G$ of the driving current of the green LED G is compensated when the level $i_G$ of the driving current of the green LED G has the maximum value and the level $i_M$ of the driving current of the magenta LED M is compensated when the duty $D_M$ of the driving current of the magenta LED M has the maximum value at the same time, to correspond to the target color coordinates and the target luminance.

When the duty $D_G$ of the driving current of the green LED G is compensated, a ratio in increasing luminance using the duty $D_M$ and the level $i_M$ of the driving current of the magenta LED M are not adjusted. Accordingly, distortion of the color coordinates may not be effectively prevented. In this case, the level $i_M$ of the driving current of the magenta LED M reaches the maximum value earlier than the duty $D_G$ of the driving current of the green LED G Accordingly, in an exemplary embodiment, when the level $i_M$ of the driving current of the magenta LED M reaches the maximum value and then the lookup table is not used, the duty $D_M$ of the driving current of the magenta LED M is additionally adjusted. Specifically, the maximum value of the duty $D_M$ of the driving current of the magenta LED M may be preset to be a predetermined value of about 80% of a maximum margin.

In an exemplary embodiment, adjustment for two-way dimming driving is implemented, but alternative exemplary embodiments are not limited thereto. For example, in a three-way dimming driving using the red, green and blue LEDs, color coordinates may be adjusted according to Equation 3.

$$i_G \times \sum_{j=1}^{N} (D_G)'_j + i'_R \times \sum_{k=1}^{N} (D_R)_k + i'_B \times \sum_{l=1}^{N} (D_B)_l = P_{normal} \qquad \text{Equation 3}$$

In the three-way dimming driving method according to an exemplary embodiment, the duty $D_G$ of the driving current of the green LED G, the level $i_R$ of the driving current of the red LED and the level $i_B$ of the driving current of the blue LED are adjusted as the pair.

Figure 5:
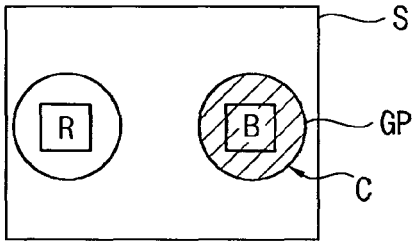

Referring now to FIG. 5, the light-emitting group S according to an exemplary embodiment includes a red LED R and a cyan LED C. The cyan LED C includes a blue chip B and a green phosphor GP covering the blue chip B. The green phosphor GP may be mixed with a silicone resin or an epoxy resin.

The red LED R and the cyan LED C may be disposed in respective packages. Alternatively, the red LED R and the cyan LED C may be disposed in a single package. Moreover, more than two chips may be disposed in a single package.

Figure 6:
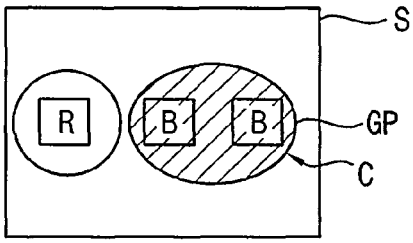

Referring to FIG. 6, the light-emitting group S includes the red LED R mounted on the single package and two blue chips B covered with the green phosphor GP are mounted in the single package. For example, at least one red chip R covered with the green phosphor GP and at least one blue chip B covered with the green phosphor GP may be mounted in the single package.

Figure 7:
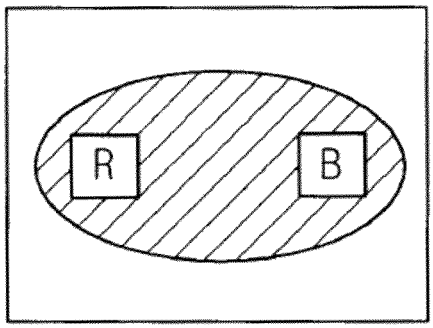

Referring to FIG. 7, the light-emitting group S according to an exemplary embodiment includes the single package in which a red chip R and a blue chip B are disposed. As illustrated in FIG. 7, the green phosphor GP covers the red chip R and the blue chip B. Alternatively, the green phosphor GP may cover only the blue chip B. The green phosphor GP may be mixed with the silicone resin or the epoxy resin.

In FIGS. 4, 5, 6 and 7, the light-emitting group S includes LEDs having two colors, but the light-emitting group S according to alternative exemplary embodiments is not limited to the foregoing description. For example, the light-emitting group S according to an alternative exemplary embodiment may include a combination of LEDs and cold cathode fluorescent lamps ("CCFLs") (not shown).

When the light-emitting group S includes the combination of the LED which has a blue chip and a yellow phosphor covering the blue chip, a red CCFL and a green CCFL may be included, for example. Alternatively, in a backlight assembly using a carbon nanotube ("CNT"), an upper glass may be covered with red, green and blue phosphor in a substantially matrix pattern.

Hereinafter, color reproducibility and power efficiency according to the exemplary embodiment of the light-emitting group S shown FIG. 7 will be described in further detail.

Figure 8:
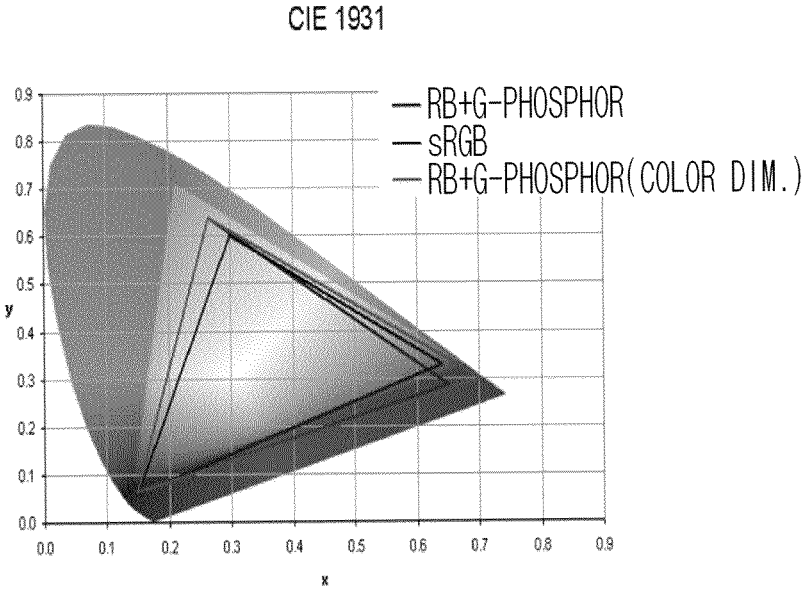
FIG. 8 is a graph of x and y color coordinates of an exemplary embodiment of a light source apparatus including the light-emitting group shown in FIG. 7.

FIG. 8 is a graph of x and y color coordinates of an exemplary embodiment of a light source apparatus including the light-emitting group S shown in FIG. 7.

Referring to FIG. 8, when the light source apparatus including the light-emitting group S of FIG. 7 is driven, the sRGB color space is mostly covered. In FIG. 8, the sRGB color space is the C.I.E. 1931 color space.

TABLE 1

| RB CHIP + G-PHOSPHOR | | | | |
|---|---|---|---|---|
| | C.I.E 1931 | | C.I.E 1976 | |
| | X | Y | U' | V' |
| WHITE | 0.2499 | 0.2955 | 0.1653 | 0.4399 |
| RED | 0.6519 | 0.2871 | 0.5072 | 0.5026 |
| GREEN | 0.2646 | 0.6361 | 0.1048 | 0.5666 |
| BLUE | 0.1473 | 0.0629 | 0.1703 | 0.1636 |
| GAMUT | 83.1031 | | 106.1406 | |

TABLE 2

| RB CHIP + G-PHOSPHOR(COLOR DIM) | | | | |
|---|---|---|---|---|
| | C.I.E 1931 | | C.I.E 1976 | |
| | X | Y | U' | V' |
| WHITE | 0.2499 | 0.2955 | 0.1653 | 0.4399 |
| RED | 0.7011 | 0.2980 | 0.5420 | 0.5184 |
| GREEN | 0.2646 | 0.6361 | 0.1048 | 0.5666 |
| BLUE | 0.1473 | 0.0629 | 0.1703 | 0.1636 |
| GAMUT | 91.6122 | | 116.2759 | |

Table 1 represents data illustrating color reproducibility when a light source apparatus including a light-emitting group S of FIG. 7 is driven using a hold-type driving method. Table 2 represents data illustrating color reproducibility when a light source apparatus including the light-emitting group S of FIG. 7 is driven using a dimming-type driving method according to an exemplary embodiment.

Referring to Tables 1 and 2, when the light source apparatus is driven by dimming, color reproducibility is higher than that of the light source apparatus driven without dimming by about 91.6%. The color spaces of Tables 1 and 2 are the C.I.E. 1931 and C.I.E. 1976 color spaces.

TABLE 3

| RB CHIP + G-PHOSPHOR(COLOR DIM) | | | | |
|---|---|---|---|---|
| | C.I.E 1931 | | C.I.E 1976 | |
| | X | Y | U' | V' |
| WHITE | 0.2499 | 0.2955 | 0.1653 | 0.4399 |
| RED | 0.7011 | 0.2980 | 0.5420 | 0.5184 |
| GREEN | 0.2646 | 0.6361 | 0.1048 | 0.5666 |
| BLUE | 0.1473 | 0.0629 | 0.1703 | 0.1636 |
| GAMUT | 91.6122 | | 116.2759 | |

Table 3 represents data illustrating light intensity and power efficiency of a light source apparatus including the light-emitting group S shown in FIG. 7.

Referring Table 3, the two-way dimming-type driving according to an exemplary embodiment has a higher light intensity (e.g., about 65% higher) and higher power efficiency (e.g., about 60% higher) than a dimming-type driving method according to the prior art. Thus, by using the phosphor, exemplary embodiments substantially reduce a required number of LEDs, and a light intensity and power efficiency thereof are substantially enhanced.

Figure 9:
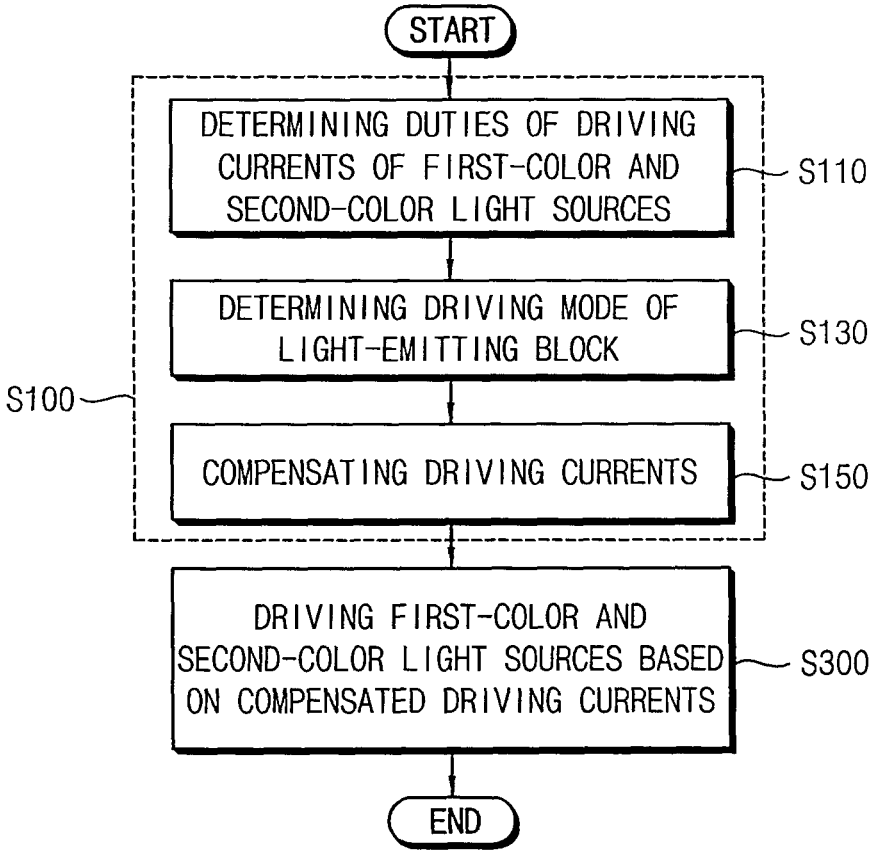
FIG. 9 is a flowchart for explaining an exemplary embodiment of a method for driving a light source according to the present invention.

FIG. 9 is a flowchart for explaining an exemplary embodiment of a method for driving a light source. Referring to FIGS. 1, 2 and 9, the light source module 310 according to an exemplary embodiment includes a plurality of the light-emitting blocks BL and each of the light-emitting blocks BL of the plurality of light-emitting blocks BL includes first-color light sources 312 and second-color light sources 314. The first-color light sources 312 emit first-color light and the second-color light sources 314 emit second-color light. Each of the second-color light sources 314 is disposed in a single package having a third-color chip and a fourth-color phosphor disposed on, e.g., substantially covering, the third-color chip. In an exemplary embodiment of a method for driving the light source module 310 by the light-emitting blocks BL, a driving current of each light-emitting block BL is compensated (STEP S100).

In the STEP S100, duties of the driving currents of the first-color light sources 312 and the second-color light sources 314 are determined based on image data DATA corresponding to each of the light-emitting blocks BL (STEP S110). A driving mode of each of the light-emitting blocks BL is determined based on the duties of the driving currents (STEP S130).

In the STEP S130, when the driving mode is a normal mode, the duties of the driving currents of the first-color light sources 312 and the second-color light sources 314 are compensated and are provided to the light source driving part 350. When the driving mode is a boost mode, at least one of the duties and levels of the driving currents of at least one of the first-color light sources 312 and the second-color light sources 314 is compensated (STEP S150).

Specifically, the duties and levels of the driving currents is compensated by using a lookup table which stores the duty of the driving current of the first-color light sources 312 and the level of the driving current of the second-color light sources 314 corresponding to target color coordinates and target luminance as a pair.

For example, in an exemplary embodiment, each of the first-color light sources 312 may be a green LED G and each of the second-color light sources 314 may be a magenta LED M. The magenta LED M may include a blue chip B and a red phosphor RP disposed on, e.g., substantially covering, the blue chip B. The red phosphor RP may be mixed with a silicone resin and/or an epoxy resin. The green LED G and the magenta LED M may be disposed in respective packages. Alternatively the green LED G and the magenta LED M may be disposed in a single package.

The lookup table stores the duty of the driving current of the green LED G and the level of the driving current of the magenta LED M as the pair (satisfying Equation 2, described in greater detail above).

In this case, the lookup table includes data which corresponds to the target color coordinates and the target luminance by compensating the duty of the driving current of the green LED G when the level of the driving current of the green LED G has a maximum value and, similarly, compensating the level of the driving current of the magenta LED M when the duty of the driving current of the magenta LED M has a maximum value at the same time.

In STEP S300, the first-color light sources 312 and the second-color light sources 314 are driven based on the compensated driving currents in the STEP S100.

As shown in FIG. 8 and Tables 1, 2 and 3, the two-way dimming-type driving according an exemplary embodiment has a substantially higher color reproducibility, a substantially higher light intensity and a substantially higher power efficiency than a dimming-type driving method according to the prior art.

Thus, in a light source apparatus according to exemplary embodiments as described herein, manufacturing costs are substantially decreased by reducing a required number of LEDs, while reliability is substantially increased by reducing a required number of wires. In addition, color reproducibility and power efficiency are substantially improved.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims

What is claimed is:

1. A method for driving a light source, the light source comprising light-emitting blocks, each of the light-emitting blocks including a first-color light source which emits first-color light and a second-color light source which emits second-color light, the second-color light source comprising a third-color chip and a fourth-color phosphor disposed on the third-color chip, the third color chip and the fourth-color phosphor disposed as one package to emit the second-color light therefrom, the method comprising:

compensating a driving current of the first-color light source and a driving current of the second-color light source of each of the light-emitting blocks based on image signal data corresponding to each of the light-emitting blocks, respectively, to generate a compensated driving current of the first-color light source and a compensated driving current of the second-color light source; and driving the first-color light source and the second-color light source based on the compensated driving current of the first-color light source and the compensated driving current of the second-color light source, respectively, wherein the compensating the driving current of the first-color light source and the driving current of the second-color light source comprises:

determining a duty of the driving current of the first-color light source and a duty of the driving current of the second-color light source using image data corresponding to each of the light-emitting blocks;

determining a driving mode of each of the light-emitting blocks based on the duty of the driving current of the first-color light source and the duty of the driving current of the second-color light source; and compensating the driving current of the first-color light source and the driving current of the second-color light source based on the driving mode, and wherein the determining the duty of the driving current of the second-color light source comprises:

generating representative data by sampling a larger one of third-color and fourth-color data of the image data; and determining the duty of the driving current of the second-color light source based on the representative data.

2. The method of claim 1, wherein the compensating the driving current of the first-color light source and the second-color light source comprises time-filtering the duty of the driving current of the first-color light source and the duty of the driving current of the second-color light source when a corresponding light-emitting block operates in a normal mode.

3. The method of claim 1, wherein the compensating the driving current of the first-color light source and the driving current of the second-color light source comprises compensating at least one of the duty and a level of at least one of the driving current of the first-color light source and the driving current of the second-color light source when a corresponding light-emitting block operates in a boost mode.

4. The method of claim 3, wherein the compensating the at least one of the duty and the level of the at least one of the driving current of the first-color light source and the driving current of the second-color light source comprises compensating the duty of the driving current of the first-color light source when the level of the driving current of the first-color light sources is maximum and compensating the level of the driving current of the second-color light source when the duty of the driving current of the second-color light source is maximum, such that the compensating the duty of the driving current of the first-color light source and the compensating the level of the driving current of the second-color light source correspond to target color coordinates and target luminance.

5. The method of claim 3, wherein the compensating the at least one of the duty and the level of the at least one of the driving current of the first-color light source and the driving current of the second-color light source comprises using a lookup table which stores a pair comprising the duty of the driving current of the first-color light source and the level of the driving current of the second-color light source corresponding to target color coordinates and target luminance.

6. The method of claim 5, wherein the compensating the at least one of the duty and the level of the at least one of the driving current of the first-color light source and the driving current of the second-color light source further comprises additionally compensating the duty of the driving current of the second-color light source when the level of the driving current of the second-color light sources is greater than a predetermined value.

7. The method of claim 1, wherein the first-color light source comprises a green light-emitting diode, and the second-color light source comprises a magenta light-emitting diode which includes a blue chip and a red phosphor disposed on the blue chip.

8. The method of claim 1, wherein the first-color light source comprises a red light-emitting diode, and the second-color light source comprises a cyan light-emitting diode which includes a blue chip and a green phosphor disposed on the blue chip.

9. The method of claim 1, wherein the fourth-color phosphor only covers the second light source of the light emitting group.

10. A light source apparatus comprising:

light-emitting blocks, each including a first-color light source which emits first-color light and a second-color light source which emits second-color light, the second-color light source comprising a third-color chip and a fourth-color phosphor disposed on the third-color chip, the third color chip and the fourth-color phosphor disposed as one package to emit the second-color light therefrom;

a local dimming control part which compensates a driving current of the first-color light source and a driving current of the second-color light source of each of the light-emitting blocks based on image signal data corresponding to each of the light-emitting blocks, respectively, and the local dimming control part comprising:

a duty determining part which determines a duty of the driving current of the first-color light source and a duty of the driving current of the second-color light source using image data corresponding to each of the light-emitting blocks;

a driving mode determining part which determines a driving mode of the light-emitting blocks based on the duty of the driving current of the first-color light source and the duty of the driving current of the second-color light source; and a compensating part which compensates the driving current of the first-color light source and the driving current of the second-color light source based on the driving mode; and a light source driving part which drives the first-color light source and the second-color light source based on the driving current of the first-color light source and the driving current of the second-color light source, respectively, each compensated by the local dimming control part, wherein the duty determining part generates representative data by sampling a larger one of third-color and fourth-color data of the image data and determines the duty of the driving current of the second-color light source based on the representative data.

11. The light source apparatus of claim 10, wherein the compensating part time-filters the duty of the driving current of the first-color light source and the duty of the driving current of the second-color light source when the light-emitting block operates in a normal mode, and the compensating part compensates at least one of the duty and a level of at least one of the driving current of the first-color light source and the driving current of the second-color light source when the light-emitting block operates in a boost mode.

12. The light source apparatus of claim 11, wherein the compensating part compensates the duty of the driving current of the first-color light source when the level of the driving current of the first-color light sources is maximum and compensates the level of the driving current of the second-color light source when the duty of the driving current of the second-color light sources is maximum, such that the duty of the driving current of the first-color light source and the level of the driving current of the second-color light source correspond to target color coordinates and target luminance when the corresponding light-emitting block operates in the boost mode.

13. The light source apparatus of claim 12, wherein the compensating part uses a lookup table which stores a pair, the pair including the duty of the driving current of the first-color light source and the level of the driving current of the second-color light source corresponding to the target color coordinates and the target luminance.

14. The light source apparatus of claim 10, wherein the first-color light source comprises a red light-emitting diode, and the second-color light source comprises a cyan light-emitting diode which includes a blue chip and a green phosphor disposed on the blue chip.

15. The light source apparatus of claim 10, wherein the first-color light source comprises a green light-emitting diode, and the second-color light source comprises a magenta light-emitting diode which includes a blue chip and a red phosphor disposed on the blue chip.

16. The light source apparatus of claim 10, wherein the first-color light source and the second-color light source include at least one red chip, at least one blue chip and a green phosphor disposed on the at least one red chip and the at least one blue chip, and the first-color light source and the second-color light source are integrally disposed together as a light-emitting diode.

17. The light source apparatus of claim 10, wherein the third-color chip includes a plurality of color chips.

18. The light source apparatus of claim 10, wherein the fourth-color phosphor is mixed with one of a silicone resin and an epoxy resin.

19. The light source apparatus of claim 10, wherein the fourth-color phosphor only covers the second light source of the light emitting group.

* * * * *